US007981357B2

(12) United States Patent
Sommer et al.

(10) Patent No.: US 7,981,357 B2
(45) Date of Patent: Jul. 19, 2011

(54) METHOD OF MAKING A SPUNBOND

(75) Inventors: Sebastian Sommer, Troisdorf (DE); Willi Liebscher, Bruchköbel (DE)

(73) Assignees: Reifenhauser GmbH & Co. KG Maschinenfabrik, Troidorf (DE); Fleissner GmbH, Egelsbach (DE)

( * ) Notice: Subject to any disclaimer, the term of this patent is extended or adjusted under 35 U.S.C. 154(b) by 493 days.

(21) Appl. No.: 12/043,283

(22) Filed: Mar. 6, 2008

(65) Prior Publication Data

US 2008/0220161 A1 Sep. 11, 2008

(30) Foreign Application Priority Data

Mar. 8, 2007 (EP) ..... 07004747

(51) Int. Cl.
*D01D 5/092* (2006.01)
*D01D 5/098* (2006.01)
*D04H 3/08* (2006.01)

(52) U.S. Cl. ..... 264/555; 28/104; 265/103; 265/210.8; 265/211.13; 265/211.2; 265/234

(58) Field of Classification Search ..... 264/103, 264/210.8, 211.13, 211.2, 234, 555; 28/104, 28/105
See application file for complete search history.

(56) References Cited

U.S. PATENT DOCUMENTS

| | | | | |
|---|---|---|---|---|
| 3,562,771 | A | 2/1971 | Fridrichsen | |
| 7,455,800 | B2 * | 11/2008 | Ferencz et al. | 264/103 |
| 2002/0033562 | A1 * | 3/2002 | Kauschke et al. | 264/555 X |
| 2003/0178742 | A1 | 9/2003 | Geus | 264/211.22 |
| 2006/0014464 | A1 | 1/2006 | Noelle | 442/401 |

FOREIGN PATENT DOCUMENTS

EP 1340843 A1 * 9/2003

* cited by examiner

*Primary Examiner* — Leo B Tentoni

(74) *Attorney, Agent, or Firm* — Andrew Wilford

(57) ABSTRACT

A spunbond web is made by extruding a multiplicity of hot thermoplastic filaments, passing the filaments along an upstream stretch of a path, cooling and stretching the filaments as they move along the upstream stretch of the path, and depositing the cooled and stretched filaments at a downstream end of the upstream stretch on a foraminous belt such that the filaments form a mat thereon. The belt is continuously displaced the belt so as to move the mat downstream along a downstream leg of the path. The mat on the belt, then consolidated with a high-pressure water-jet treatment, and further processed.

12 Claims, 2 Drawing Sheets

METHOD OF MAKING A SPUNBOND

FIELD OF THE INVENTION

The invention relates to a method of making a spunbond web of filaments, normally of a thermoplastic resin. The invention also relates to an apparatus for carrying out this method.

BACKGROUND OF THE INVENTION

It has long been known in the industry to subject a nonwoven web, normally made by depositing filaments on a belt, to a setting process. For nonwovens with masses per unit area of from 10 to 80 g/m$^2$, the deposited layer, web, or mat is as a rule consolidated by means of a thermocalender. This produces thin nonwovens with good strength. Heavier and more voluminous filament mats are more difficult to consolidate since it is very difficult to penetrate to the center of the mat with enough heat to do the compacting and entangling wanted for good consolidation. If the heat is applied long enough to melt the filaments of the core region where they touch and intersect, the surface is overcooked and melted.

If heavier and more voluminous nonwovens are to be manufactured, other consolidation methods are used, in particular mechanical needling and hydraulic needling with intense water jets or thermoconsolidation using hot air. With these consolidation methods, it is always necessary to separate the mat from the belt or sieve belt and to deliver it to the consolidation/final consolidation with as little damage as possible to the mat and without harming the uniformity of the mat.

US 2005/0077012 discloses using water jets to consolidate the filament mat immediately downstream of where it was deposited, in fact without the interposition of a heated outfeed roll. This should prevent particles or droplets from the outfeed roll from being rolled into a deposition sieve belt and thus reducing the service life of the deposition sieve belt. This system has the disadvantage that the direct consolidation of the loosely laid filament mat by means of water jets can cause unwanted irregularities. The loosely laid filament mat must therefore be secured against slippage in a particularly complex fashion.

In the context of the present invention, the term "filaments" normally refers to so-called endless filaments. Due to their quasi-endless lengths, endless filaments differ from staple fibers, that are normally considered to have significantly shorter lengths of 10 to 60 mm, for example.

OBJECTS OF THE INVENTION

It is therefore an object of the present invention to provide an improved method of making a spunbond web of filaments.

Another object is the provision of such an improved method of making a spunbond web of filaments that overcomes the above-given disadvantages, in particular that allows consolidation to carried out without harming the quality of the mat Another object of the invention is to provide an improved apparatus for carrying out the method of this invention.

SUMMARY OF THE INVENTION

A spunbond web is made according to the invention by extruding a multiplicity of hot thermoplastic filaments, passing the filaments along an upstream stretch of a path, cooling and stretching the filaments as they move along the upstream stretch of the path, and depositing the cooled and stretched filaments at a downstream end of the upstream stretch on a foraminous belt such that the filaments form a mat thereon. The belt is continuously displaced so as to move the mat downstream along a downstream leg of the path. The mat is wetted on the belt, then consolidated mat with a high-pressure water-jet treatment, and further processed after removal from the belt.

According to the invention in order to produce the filaments it is possible to use one spunbond web beam or also a plurality of spunbond web beams connected downstream of one another. The belt in accordance with the invention is a sieve belt or a deposition sieve belt. Such a sieve belt/deposition sieve belt is air-permeable and at least in the region of the mat of filaments, air is sucked through the belt from below in order to stabilize the mat. Corresponding suction units situated under the deposition sieve belt for producing corresponding subatmospheric pressures or vacuums are known. In the context of the invention, if a belt according to a preferred embodiment of the invention is mentioned, then only a single deposition sieve belt is provided, from which the nonwoven web is removed and delivered to subsequent treatment. Basically, however, the scope of the invention also includes the case in which one or more additional conveyor belts are provided, provided directly downstream of the sieve belt. In this case, the nonwoven web is taken off from the last sieve belt in the travel direction and the removed nonwoven web is then delivered to subsequent treatment.

The prewetting of the nonwoven web according to the invention is done with water. In the wetter, the mat is only wetted/prewetted and is not yet consolidated. To this extent, the prewetting and the wetter must be differentiated from hydraulic consolidation and a corresponding consolidator in which a consolidation of the mat actually occurs.

In a very preferred embodiment of the invention, the filaments coming out of the spinner or spinneret are treated in accordance with the REICOFIL III process described in U.S. Pat. No. 5,814,349 or in accordance with the REICOFIL IV process described in U.S. Pat. No. 6,918,750. In this case, it is particularly preferable that the transition region between the cooling chamber and the stretcher be closed and that except for the supply of cooling air into the cooling chamber, no additional air is supplied in this transition region.

According to the invention a closed cooling chamber is used. The expression "closed cooling chamber" in this case means that the cooling chamber is closed off from the surroundings except for the supply of cooling air and except for the introduction of the filaments accompanied by corresponding amounts of air. To that end, the cooling chamber suitably has closed walls. According to a particularly preferred embodiment of the invention, the filaments are cooled and stretched with the same cooling air. In other words, in this case, the cooling air supplied to the cooling chamber is also used for the stretching of the filaments in the stretcher. A particularly preferred embodiment of the invention is characterized in that the entire subassembly composed of the cooling chamber and the stretcher is closed and, except for the supply of cooling air into the cooling chamber, no additional air is supplied to this subassembly. In addition to the cooling air, only the filaments are introduced into the cooling chamber, from above as a rule, and naturally, also a certain amount of air gets into the cooling chamber along with these filaments. But, according to this very preferred embodiment of the invention, there is no additional supply of air in the subassembly composed of the cooling chamber and the stretcher.

According to one embodiment of the invention, upstream of the wetter in the travel direction, the mat is conveyed through at least one compacter where the mat is compacted and preconsolidated. In this compacter, therefore, only a compacting and a slight consolidation occur, but no finish consolidation of the kind that occurs with a hydraulic consolidation, a high-pressure water-jet treatment, or consolidation with a calender. Suitably, the compacting and the slight consolidation is carried out such that there are is no points or essentially no bonding points at intersections where filament cross each other and/or that no "intentional" kinking of the filaments is produced as in high-pressure water-jet treatment. Suitably, downstream of the compacting, all or essentially all of the filaments can still be separated from one another.

According to a very preferred embodiment of the invention, the compacter has at least one preferably heated outfeed roll above the belt and the outfeed roll acts on the mat from above as the web is guided through the compacter. This compacts and slightly consolidates the mat. The thickness of the mat upstream of the outfeed roll in the travel direction is greater than the spacing between the outfeed roll and the belt. The outfeed roll suitably defines the downstream end of the suction region in the mat region of the filaments. In this case, the expression "suction region" means the region of the mat in which air is sucked through the belt from below. The scope of the invention includes the fact that the surface temperature of the outfeed roll is between room temperature and 5° C. below the melting point of the filament material or of the filament material provided on the outside of the filaments. The surface temperature of the outfeed roll is suitably at least 30° C., preferably at least 35° C., so that they are warm, but not hot enough to melt the synthetic resin of the filaments. According to a particularly preferred embodiment of the invention, two outfeed rolls are provided; one outfeed roll is provided above the belt, spaced by a gap above the belt, and the downstream outfeed roll is provided below the belt. The mat resting on the belt here is guided through and between the two outfeed rolls. The outfeed roll provided above the belt is the outfeed roll described above; the preferred embodiments described above also apply to this outfeed roll in the embodiment with two outfeed rolls. According to one embodiment, the lower outfeed roll can also be heated. In this case, the upper outfeed roll and the lower outfeed roll can have the same temperature or essentially the same temperature. The invention is based on the recognition that the use of the outfeed roll(s) increases the resistance of the mat to shifts caused by air movements. In this embodiment, the suction region is sealed in the vicinity of the filament mat, thus permitting a simple, definite control of the air movements in this region.

According to the invention, the mat is prewetted in at least one wetter upstream of the consolidation. If an above-described compacter is provided, then it is advisable for the mat to first be conveyed out of the compacter and only then introduced into the wetter. According to one embodiment of the invention, it is also possible for one or more wetters to be provided that are suitably provided one downstream of the other and are preferably all provided upstream of the consolidation. The scope of the invention also includes the fact that in the prewetting, a fluid medium, preferably water, is applied to the mat. Preferably, the fluid medium/water is applied to the mat from above. The water passing through the mat and the deposition sieve belt is collected underneath the deposition sieve belt in suitable fashion. It is advisable for a suction of the fluid medium/water to take place underneath the deposition sieve belt.

A preferred embodiment is characterized in that the mat is prewetted in the wetter with a fluid medium that comes out of a plurality of nozzles at a pressure of 2 to 40 bar, advantageously at a pressure of 2 to 20 bar, and preferably at a pressure of 3 to 10 bar. In particular, the fluid medium is water. In this preferred embodiment, the prewetting therefore is done by means of water jets that emerge at a relatively low pressure, in comparison to the consolidation by means of so-called needle jets, and strike the mat. The nozzles are provided on at least one water-jet beam that extends transversely across the mat. It is possible for a plurality of water-jet beams to be provided one downstream of the other. The above-mentioned water-jet beams are similar to the high-pressure water-jet beams used for the consolidation so that this permits a flexible replaceability of wearing parts. However, operation in the wetter occurs at significantly lower pressures than in the water-jet consolidation. For this reason, the nozzles used in the wetter can be constructed of lighter weight materials. In this embodiment with nozzles/low-pressure nozzles, the fluid medium/water is pushed through the mat and through the deposition sieve belt into a drainage opening, preferably a drainage slot, provided below the deposition sieve belt. This at least one drainage opening or this at least one drainage slot is suitably subjected to a negative pressure or vacuum.

Furthermore according to the invention the nozzles/low-pressure nozzles are provided above the mat or above the surface of the mat, spaced from it by a distance of 10 to 400 mm, in particular 30 to 400 mm, advantageously 60 to 400 mm, preferably 100 to 400 mm, and very preferably 125 to 250 mm. In this case, the term "distance" refers to the distance between the nozzle openings and the surface of the mat. In comparison to the above-mentioned relatively large distances of the nozzles/low-pressure nozzles, the high-pressure water-jet nozzles of the consolidation are provided relatively close to the mat, preferably spaced apart from the surface of the mat by a distance of 5 to 20 mm. Due to the long spraying path in the wetter, the water jets break up, producing a rain of droplets. This contrasts with the procedure in the consolidation in which steps are taken to keep the water jets together until they strike the nonwoven. In the wetter, the low pressure of the fluid medium and the relatively large distance of the nozzles from the surface of the mat yield a "soft" contact, so to speak, of the fluid medium/water with the mat. The invention is based on the recognition that this permits a particularly uniform introduction of the fluid medium/water into the mat. Because of the gentle wetting of the mat, it is possible to avoid interfering air movements and their negative impact on the uniformity of the mat. In other words, thanks to the soft, gentle contact of the fluid medium/water with the mat in the prewetting, it is possible to minimize displacements of the mat or displacements of filaments in the mat. It should also be emphasized that preferably, no compacting of the mat takes place in the wetter. The term "compacting" here refers to the action on the mat from above with a roller or outfeed roll, a compacting belt, or endless compacting belt. In this connection, "compacting" does not refer to a possible slight deformation of the mat resulting from the action of the fluid medium for wetting.

According to another embodiment variant, for the prewetting of the mat in the wetter, a fluid medium, preferably water, is sprayed in a mist and the mat is then prewetted with this mist. The fluid medium/water in this case is suitably sprayed or atomized by means of blowing strips for compressed air or by means of spray beams. The mat is suitably prewetted with the mist from above. The fluid medium/water then penetrates the mat and partially penetrates the deposition sieve belt and is suitably collected in at least one drainage opening or at least one drainage slot below the deposition sieve belt. The drainage opening or drainage slot is provided either directly under or essentially directly under the blowing strips or is provided downstream of the blowing strips in the travel direction of the mat. The distance from the blowing strips in this case is in particular 2 to 150 cm, preferably 5 to 100 cm. According to a particularly preferred embodiment, the drainage opening or drainage slot is subjected to a negative pressure, suitably a negative pressure of 50 to 200 mbar, preferably 50 to 150 mbar. In this embodiment with the mist prewetting, the negative pressure applied to the drainage opening or drainage slot is very advantageous for the function of the prewetting. The fluid medium/water is sucked into the mat, so to speak.

As an alternative to the above-mentioned blowing strips, the fluid medium/water for prewetting the mat can also be provided by means of an overflow weir. According to a preferred embodiment of the invention, the prewetting of the mat occurs both by means of the above-described water-jet prewetting and by means of the above-described mist prewetting.

With regard to the prewetting of the mat, the invention is based on the recognition that the fluid medium/water introduced between the filaments modifies the filament/filament friction coefficients and in this respect functions as a sort of adhesion promoter. The fluid medium/water introduced into the mat by the wetting step reduces movements of or in the mat. On the other hand, the prewetting with the fluid medium/water does not hinder the kinking of the filaments in the subsequent consolidation by means of high-pressure water-jet treatment.

The scope of the invention includes the fact that the consolidation of the mat with high-pressure water jets is carried out at a water pressure of 60 to 150 bar, preferably 60 to 120 bar, and very preferably 70 to 100 bar. As a rule, the water pressure of the high-pressure water jets is around 100 bar. It is advisable to set the water pressure as a function of the line speed and/or the nonwoven weight and/or the yarn count and/or the raw material of the filaments and/or the desired/required intensity of the consolidation. Basically, one or more high-pressure water-jet beams can be provided and can be suitably oriented transversely of the mat. The distance of the high-pressure water-jet nozzles from the surface of the mat is in particular 5 to 50 mm, advantageously 5 to 25 mm, and preferably 10 to 20 mm. Thus the consolidating nozzles are at least five times and at most 35 times closer than the wetting nozzles, preferably around one tenth the spacing of the wetting jets. In this case, the term "distance" refers to the distance of the high-pressure water-jet nozzle openings from the surface of the mat. The scope of the invention includes the fact that the high-pressure water-jet nozzles are provided above the mat.

According to a particularly preferred embodiment of the invention, the mat is dewatered on the belt downstream of the consolidation. As a rule, the hydraulically consolidated mat has a relatively high water content that is reduced/minimized with the above-mentioned dewatering. This dewatering preferably takes place by means of suction (underneath the deposition sieve belt) or by blowing air or, in a suitable fashion, warm air, through the mat and the deposition sieve belt. The scope of the invention includes the fact that the dewatering is carried out on the deposition sieve belt that effectively supports the mat in this case.

The consolidated and preferably dewatered mat is then removed from the deposition sieve belt and sent off to subsequent treatment. In this context, "subsequent treatment" refers in particular to a final consolidation of the mat. In this case, the subsequent treatment or final consolidation can be carried out in an on-line method (continuously) or in an off-line method (discontinuously). In the off-line method, the mat can, in particular, first be wound onto a winding reel for further processing. For example, "further processing" of the mat also means the drying of the preconsolidated nonwoven, for example in a drum-type drier or the like.

To solve the technical problem, the invention also teaches an apparatus for carrying out the method according to the invention having at least one spinning device for producing the filaments, a cooling chamber, a stretcher, and a depositing device one downstream of the other in the movement direction of the spun filaments. A belt is provided for receiving the filaments and forming the mat. At least one wetter is provided for prewetting the mat that is conveyed on the belt. Downstream of the wetter in the transport direction of the mat, at least one consolidator is provided that uses high-pressure water jets to hydraulically consolidate the mat accommodated on the belt. Finally means is provided for removing the consolidated mat from the belt and at least one subsequent treatment unit is provided for subsequent treatment of the removed mat.

The depositing device of the apparatus according to the invention has at least one diffuser. The filaments emerging from the diffuser are deposited on the belt to form the mat. In particular, the subsequent treatment unit is a final consolidator for the removed mat.

Basically, the spunbond webs produced according to the invention can be composed of monocomponent filaments, multicomponent filaments, or bicomponent filaments. A spunbond web produced according to the invention can also have a blend of monocomponent filaments and multicomponent filaments/bicomponent filaments. The steps according to the invention can also be used to easily manufacture a multi-deposited or layered spunbond web. In a suitable fashion, the spinning beams associated with each depositing device of the spunbond web are provided one downstream of the other and the inventive treatment of the nonwoven mat, in particular the inventive prewetting of the nonwoven mat and the subsequent hydraulic consolidation, then takes place downstream of the last spinning beam in the travel direction. When spunbond webs with high masses per unit area are to be produced, the scope of the invention also includes the case in which the steps according to the invention are carried out downstream of each of the above-mentioned spinning beams, in particular the inventive prewetting of the nonwoven mat and the subsequent hydraulic consolidation.

The invention is based on the recognition that the steps according to the invention assure both a functionally reliable hydraulic consolidation and a functionally reliable delivery of the mat to the final consolidation, without impairment of the quality of the mat. A uniform mat with a uniform filament distribution and arrangement is maintained with the treatment steps according to the invention. In particular, this is done by avoiding unwanted shifts of the mat that harm uniformity. The invention nevertheless assures a reasonably priced manufacture of spunbond webs and in comparison to the methods/apparatuses known up to this point, it is possible to effectively minimize the amount of energy required in continuous production.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
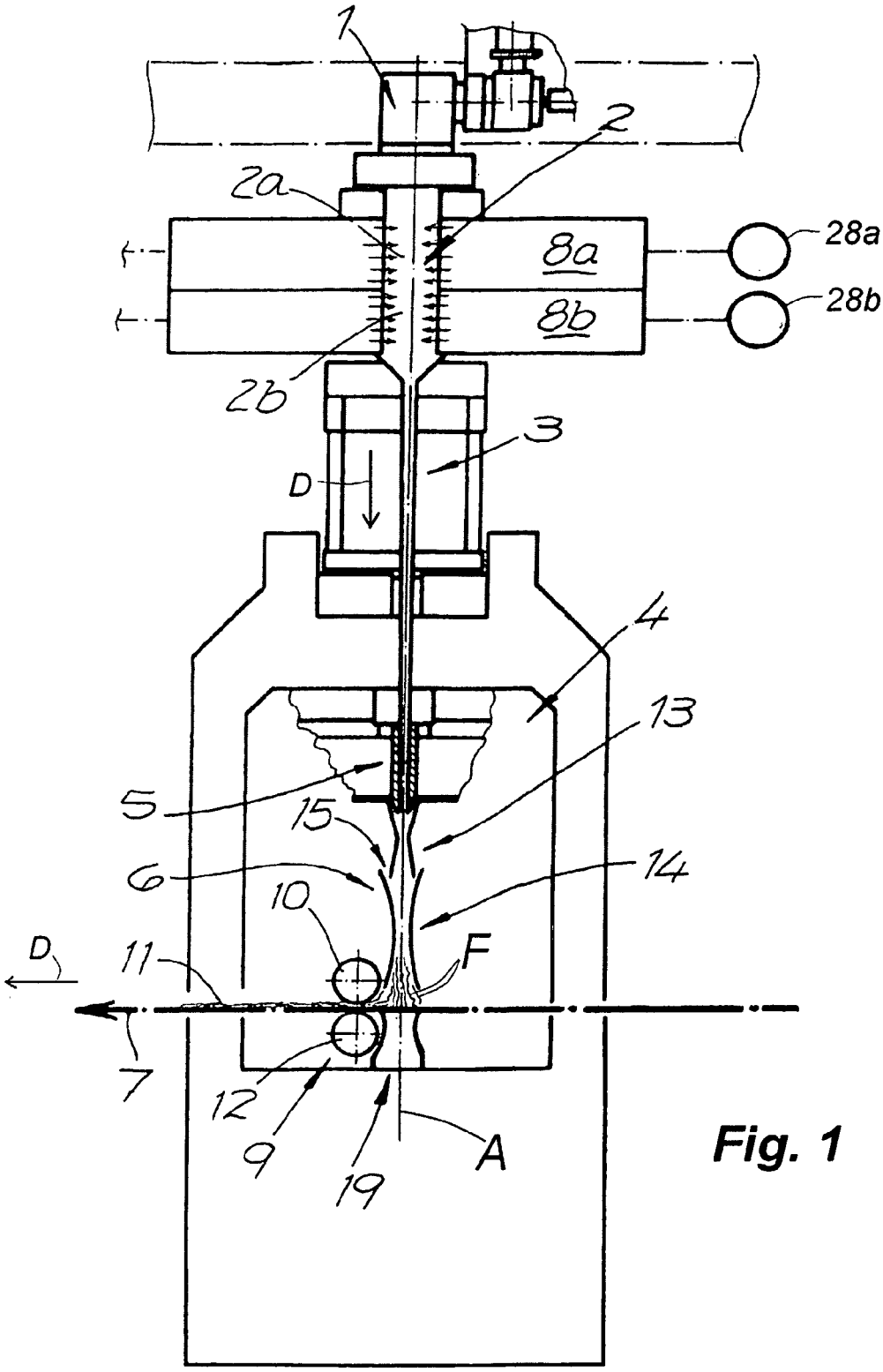
FIG. 1 is a partly schematic side view of the mat-forming system used with the instant invention.

FIG. 1 shows a mat former that is constructed along the lines of that shown in U.S. Pat. No. 6,918,750, whose entire disclosure is herewith incorporated by reference. Thermoplastic-resin filaments F are emitted by a multinozzle spinneret 1 and then drop down through a cooling chamber 2 subdivided into an upper section 2*a* and a lower section 2*b* centered on a vertical system axis A. In practice the spinneret 1 has a number of rows of transversely spaced nozzle openings from which a thick curtain of the filaments F drops. The cooling chamber 2 is followed in the downward flow direction by an intermediate passage 3 in turn followed by a draw-down passage 5 serving as a stretching unit 4. Underneath the draw-down passage 5 is a deposition device 6 and below the deposition device 6 a substrate 7 onto which the filaments are deposited, here the upper reach of a foraminous or mesh conveyor belt moving as shown here from right to left. Thus the filaments F land on the belt 7 and go from vertical to horizontal as the belt 7 advances, forming a loose nonwoven mat 11 on the belt 7.

The cooling chamber 2 and the intermediate passage 3 as well as in the transition region between cooling chamber 2 and intermediate passage 3 are blocked off from air from the outside, except for the supply of the process or cooling air for cooling the filaments F in the cooling chamber 2. Preferably, except for the mentioned supply of the process or cooling air, no additional air supply from the outside takes place into the cooling chamber 2, intermediate passage 3 and draw-down passage 5. This is thus a closed system.

As described in the above-cited US patent, the two sections 2*a* and 2*b* are associated with respective air-supply cabinets 8*a* and 8*b* having respective blowers 28*a* and 29*b*. This way the filaments in the two cooling sections 2*a* and 2*b* can be acted on with cooling air of different temperatures and/or of different flow rates and/or of different humidities.

The intermediate passage 3 serves primarily to let the thermal treatment in the stretch 3 set somewhat. Then in the downstream passage the filament F are subjected to powerful concurrent downward stream of air to stretch them. Downstream of the pull-down passage 5 is a depositing device 6 that in the illustrated embodiment has an upstream diffuser 13 and a downstream diffuser 14. Between the upstream diffuser 13 and the downstream diffuser 14, an ambient air inlet gap 15 is provided. Below the depositing device 6 is the continuously moving deposition sieve belt 7. The air blasting downward in the aligned passages 2, 3, and 4 flattens the filaments F against the belt 7 to form the mat 11 moving off in now horizontal direction D.

Figure 2:
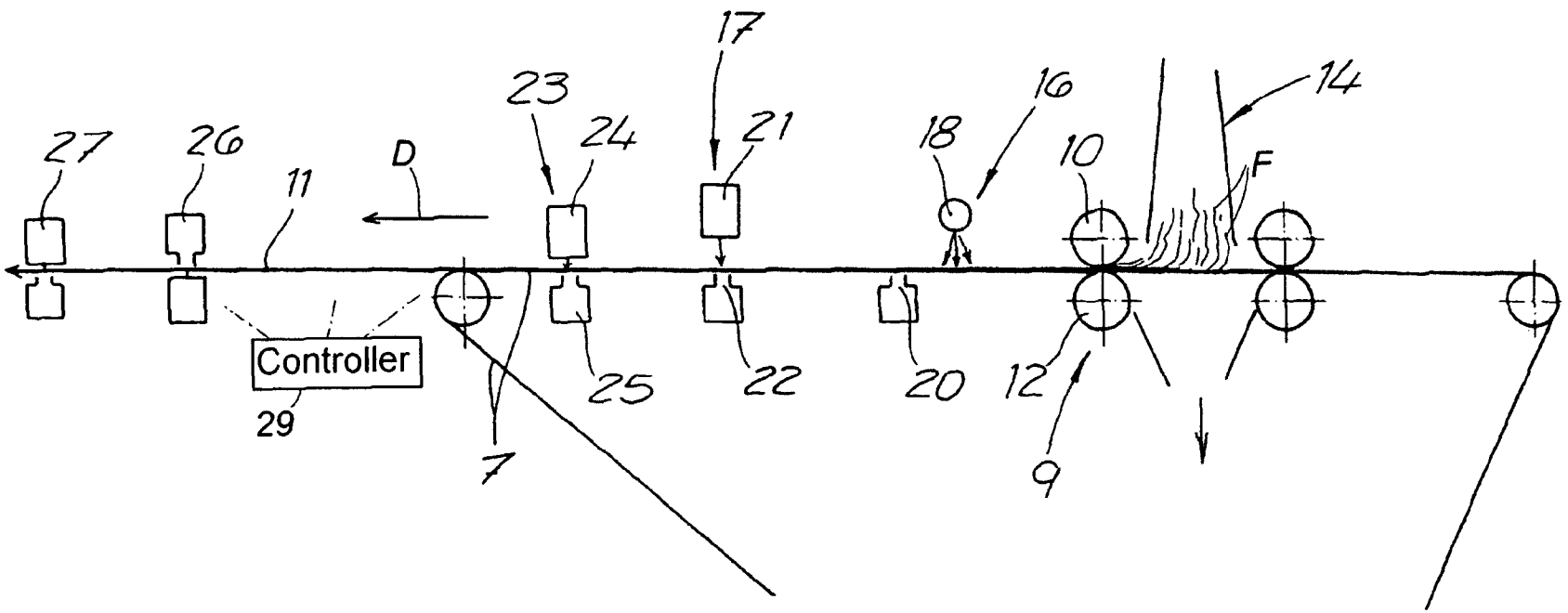
FIG. 2 is a schematic diagram illustrating the entire inventive method and apparatus according to the invention.

As shown in FIG. 2, the region of the mat downstream of the depositor 6, passes over a suction unit 19 that is below the belt 7 and sucks air downward through it, thereby forming a first preconsolidation of the mat 11. This mat 11 and suction region are followed in the travel direction D by a compacter 9 composed of two heated outfeed rolls 10 and 12. The upper outfeed roll 10 is above the mat 11 and above the deposition sieve belt 7 and the lower outfeed roll 12 is directly underneath the deposition sieve belt 7. The mat 11 is conveyed through and between the two heated outfeed rolls 10 and 12 and is thus compacted and slightly consolidated for a second more intense preconsolidation.

FIG. 2 further shows that an upstream wetter 16 and a downstream wetter 17 moisten or prewet the mat 11 downstream of the compacter 9 in the travel direction D of the mat 11. The upstream wetter 16 has a spray beam 18 extending transversely and horizontally across and above the mat 11 and the deposition sieve belt 7. This spray beam 18 of the upstream wetter 16 sprays water in the form of a mist and premoistens the mat with this mist. This is schematically depicted in FIG. 2. Downstream of the spray beam 18 in the travel direction of the mat 11 is a suction slot 20 underneath the deposition sieve belt 7 that applies suction to the water applied in the prewetting step by drawing air and entrained moistening liquid through the mat 11. This suction slot 20 draws water all through the thickness of the mat 11, even though it is only applied to its upper surface by the spray beam 18.

The mat 11 then passes through the downstream wetter 17 by means of which the mat is again wetted with water that comes out of a plurality of nozzles at a low pressure. This wetter 17 has a low-pressure water-jet beam 21, by which is meant this is not a so-called needle-jet device, that extends horizontally transversely across the mat. In practice, a plurality of such low-pressure water-jet beams 21 can be provided one downstream of the other in the travel direction of the mat 11. FIG. 2 shows that the low-pressure water-jet beam 21 is above the mat 11, spaced from it by a relatively large distance. Directly underneath the low-pressure water-jet beam 21 here there is a suction slot 22 into which is aspirated the water that has been forced through the mat 11 and through the deposition sieve belt 7. This suction slot 22 is also be acted on with a subatmospheric pressure.

The downstream wetter 17 is followed in the transport direction of the mat 11, with the mat 11 still resting on the belt, by a consolidator 23 in which the prewetted mat 11 is consolidated on the deposition sieve belt 7 by means of high-pressure water-jet treatment. In this case, a plurality of high-pressure water-jet nozzles emit high-pressure water jets at a water pressure that is in fact higher than the pressure of the water jets in the downstream wetter 17, this being a standard needle-jet apparatus emitting streams of water at with considerable kinetic energy. FIG. 2 shows a high-pressure water-jet beam 24 that extends transversely across the mat 11 and emits the above-mentioned high-pressure water jets that act on and consolidate the mat 11. The high-pressure water-jet beam 24 is spaced above the mat 11 and belt 7 by a significantly smaller distance than the low-pressure water-jet beam 21 of the downstream wetter 17. One or more further such high-pressure needle-jet type consolidators can also be provided one behind the other in the travel direction of the mat 11. Underneath the mat 11 and belt 7 just opposite the needle-nozzle beam 24 is another suction slot 25 also takes place under the deposition sieve belt 7. That draws off the bulk of the large volume of water driven into the mat 11 by the beam 24.

Then the mat 11 is removed from the deposition sieve belt 7 and fed off for subsequent treatment. FIG. 2 schematically depicts two subsequent treatment units 26 and 27. The unit 26 can be a dryer or other treatment device. The treatment unit 27 can be another needle-jet consolidator for further consolidation the mat 11 with high-pressure water jets. Here, too, a suction unit is shown underneath the mat 11. The consolidation and final consolidation here can also be carried out on a drum that is not shown.

We claim:

1. A method of making a spunbond web, the method comprising the steps of:

extruding a multiplicity of hot thermoplastic filaments;

passing the filaments along an upstream stretch of a path;

cooling and stretching the filaments as they move along the upstream stretch of the path;

depositing the cooled and stretched filaments at a downstream end of the upstream stretch on a foraminous belt such that the filaments form a mat thereon;

continuously displacing the belt so as to move the mat downstream along a downstream leg of the path;

precompacting the mat on the belt substantially without making bonding points at intersections where filaments cross one another;

spraying the precompacted mat on the belt with a mist and thereby prewetting the mat on the belt without consolidating the mat on the belt;

consolidating the prewetted mat with a high-pressure water-jet treatment; and further processing the consolidated mat.

2. The method defined in claim 1, further comprising the step of:

passing the filaments through a diffusor immediately upstream along the upstream stretch from the belt.

3. The method defined in claim 2, further comprising the step of confining the filaments in the upstream stretch where they are cooled and stretched in a laterally closed passage that generally excludes the entry of ambient air.

4. The method defined in claim 3, further comprising the step of supplying only process air to the passage.

5. The method defined in claim 1 wherein the mat is precompacted by being compressed vertically between a pair of rollers.

6. A method of making a spunbond web, the method comprising the steps of:

extruding a multiplicity of hot thermoplastic filaments;

passing the filaments along an upstream stretch of a path;

cooling and stretching the filaments as they move along the upstream stretch of the path;

depositing the cooled and stretched filaments at a downstream end of the upstream stretch on a foraminous belt such that the filaments form a mat thereon;

continuously displacing the belt so as to move the mat downstream along a downstream leg of the path;

precompacting the mat on the belt substantially without making bonding points at intersections where filaments cross one another;

spraying the precompacted mat on the belt with a mist and thereby prewetting the mat on the belt without consolidating the mat on the belt by nozzles spaced by a distance of 10 to 400 mm above the mat;

consolidating the prewetted mat with a high-pressure water-jet treatment; and further processing the consolidated mat.

7. The method defined in claim 6 wherein the distance is 10 to 250 mm.

8. The method defined in claim 1 wherein the consolidation is carried out with water jets at a pressure of 60 to 150 bar.

9. The method defined in claim 8 wherein the pressure is 70 to 100 bar.

10. The method defined in claim 1 wherein the consolidation is carried out by high-pressure water jets at a spacing of 5 to 50 mm from the mat.

11. The method defined in claim 10 wherein the spacing is 10 to 20 mm.

12. The method defined in claim 1, further comprising the step of:

dewatering the consolidated mat.

* * * * *